United States Patent [19]

Naqib

[11] Patent Number: 4,647,924

[45] Date of Patent: Mar. 3, 1987

[54] DEVICE FOR ALPHANUMERIC ARABIC DISPLAY FOR PRINTING

[76] Inventor: Isam Naqib, Physics Department, University of Kuwait, P.O. Box 5969, Kuwait

[21] Appl. No.: 662,136

[22] Filed: Oct. 18, 1984

[30] Foreign Application Priority Data

Oct. 18, 1983 [GB] United Kingdom ..... 8327856

[51] Int. Cl.[4] ..... G09G 3/04

[52] U.S. Cl. ..... 340/756

[58] Field of Search ..... 340/756, 781, 782, 784, 340/774

[56] References Cited

U.S. PATENT DOCUMENTS

| | | | |
|---|---|---|---|
| 4,260,987 | 4/1981 | Osman | 340/756 |
| 4,261,126 | 4/1981 | Bezjian | 340/756 X |
| 4,262,291 | 4/1981 | Zammit et al. | 340/756 |
| 4,368,464 | 1/1983 | Azzam | 340/756 |
| 4,394,651 | 7/1983 | Frankston et al. | 340/756 |

*Primary Examiner*—Gerald L. Brigance
*Assistant Examiner*—Vincent P. Kovalick
*Attorney, Agent, or Firm*—Antonelli, Terry & Wands

[57] ABSTRACT

A device for displaying or printing Arabic letters and numerals comprises a number of independently energizable segments. Several segments, 1, 2, 4, 8, 7, 9 and 5 are arranged in the conventional "7 segment" display configuration and groups of segments 13, 14 and 15, 16 provide groups of dots in the upper rectangular area A1 and below the cross-bar segment 9. A further segment 6 forms an enclosure completed by the upper major portion of the segment 1. Descenders 3 and 11 are provided while a linking segment 12 makes it possible to give the appearance of joined script where a number of display elements are disposed side-by-side.

19 Claims, 10 Drawing Figures

DEVICE FOR ALPHANUMERIC ARABIC DISPLAY FOR PRINTING

BACKGROUND OF THE INVENTION

1. Field of the Invention

This invention relates to a display or printing device which is capable, by selective energization of a number of segments, of displaying Arabic letters, numerals and words as well as European numerals.

There is a strong need for such a device in the manufacture of such apparatus as small computers, portable testing or communication equipment, etc. where production is suited to markets of the Arab people and where the requirements of relatively small display area and/or low production cost make the use of said device highly desirable.

2. Description of the Prior Art

The main problem in developing such a device is that it is more difficult to devise an arrangement of a limited number of segments which can be selectively operated to display Arabic words than it is for languages using the Latin alphabet. In the case of the latter said languages the starburst method has been successfuly and commonly employed (see, for example, GB No. 2001468) as disclosed, for example, in United Kingdom Pat. No. GB 2,001,468 B. Among the reasons for the aforementioned difficulty is that Arabic alphabetical characters do not lend themselves to simple goemetrical representation as readily as Latin letters. Another reason for the difficulty is that most Arabic letters take on two and sometimes three character forms, depending on their position in the printed word.

SUMMARY OF THE INVENTION

According to the present invention there is provided a device for displaying or printing Arabic numerals and letters and having at least one character position defined by a set of selectively energizable segments, the set comprising: a number of bar shaped segments arranged in a generally rectangular form and including two pairs of segments, each pair forming a respective character portion, three of the segments forming cross-bars between the top, middle and bottom of the uprights so as to define upper and lower enclosed areas, the lower cross-bar segment defining a baseline of the character position; a segment within the lower area and shaped to form an enclosure completed by the upper, major part of the right, lower upright segment; and two groups of segments each comprising at least two segments shaped to resemble one and two dots, respectively, one group being located within the upper enclosed area and the other group being located below the lower cross-bar segment, the upper two segments, when energized, together resembling three dots and at least one of the lower two segments, when energized, forming an enclosure with the righthand part of the baseline-defining segment. It should be noted that as used in this description and claims the term "upright" is not intended to imply that the segments in question are necessarily perpendicular to the baseline; they can, if desired be inclined.

Suitably, there may be a plurality of said sets of segments so as to define a number of side-by-side character positions. In those circumstances, or where characters are to be printed side-by-side, there may be a further linking segment on said base line so as primarily to provide, when energized a linking line between adjacent characters if such characters are joinable or to provide when not energized the necessary gap between non-joinable adjacent letters. The linking segment may have another function as it forms part of the lower descending ending for 5 characters, namely Ha, Kha, Jeem, Ain and Ghain; also the absence of this segment, i.e. its not being energized, provides the gap that must follow non-joining letters. A number of such linking segments may be provided, each between respective adjacent character positions and forming a leftward extension of the adjacent lower cross-bar segments.

The set may include a left-side descender segment having a first portion extending downwardly from the linking segment, a second portion extending rightwardly from the first portion and third portion extending upwardly from the second portion as well as a right-side descender segment having a first portion extending downwardly from the righthand end of the base-line and a second portion extending leftwardly from the lower end of its first portion, the length of which is at least approximately equal to that of the baseline-defining segment. A third, small portion may be added which extends upwardly from the lower end of its second portion.

It is convenient if the left-side descender is so shaped as to resemble a "pan" for which the baseline-defining segment is the "handle" but falls short of forming a complete enclosure with the linking segment when the two are energized together. The use of a further, filling segment between the left-side descender and the baseline provides a simple alternative means to achieve this object.

As will become apparent from the following description the invention can provide a display means for displaying Arabic letters, numerals and words as well as European numerals which consist of one or more rows of identical arrangements of opto-electrical segments, each arrangement comprising at least fifteen (preferably sixteen) segments. Eleven (preferably twelve) of the segments are bar-shaped or made up of a series of bars but it is preferable that the ends of some of the segments are tapered and that the long outer edges of some segments are curved or bent in such a way as to improve style and recognizability. The other four of the total are the two groups of segments dedicated to the display of dots which must appear below or above some Arabic letters as well as for the display of the Arabic zero character. Each of these four segments has the shape of a suitable polygon or two polygons jointed by a narrow bar. The polygons may be curved as a means of improving style and obtaining additional character display functions from said segments.

A second aspect of the invention for displaying or printing Arabic letters and numerals, comprises a device having means for receiving a sequence of Arabic letters and numerals and character generating means responsibe to the received sequence to output predetermined character patterns, the character generating means being operative to generate a first character pattern for each received letter when that letter occurs within a word, second character patterns for at least some characters when they occur at the end of words and third character patterns when predetermined ordered pairs of letters occur in the received sequence.

As will become apparent from the following description, both aspects of the present invention may be embodied in a single display or printing device.

It will be appreciated that when the device is a display device, it can be used in a wide variety of applications (pocket calculators, microcomputers and so forth) where it is desirable to be able to display both numbers and text. One further application of the device is to a display for a radio paging device. Paging devices are in extensive use and it would clearly be an advantage to be able to transmit messages which could be displayed on the pager. The first aspect of the invention provides a ready means whereby such a function can be implemented.

BRIEF DESCRIPTION OF THE DRAWINGS

The invention will now be particularly described, by way of example only, with reference to the accompanying drawings, in which.

DESCRIPTION OF THE PREFERRED EMBODIMENTS

Figure 1:
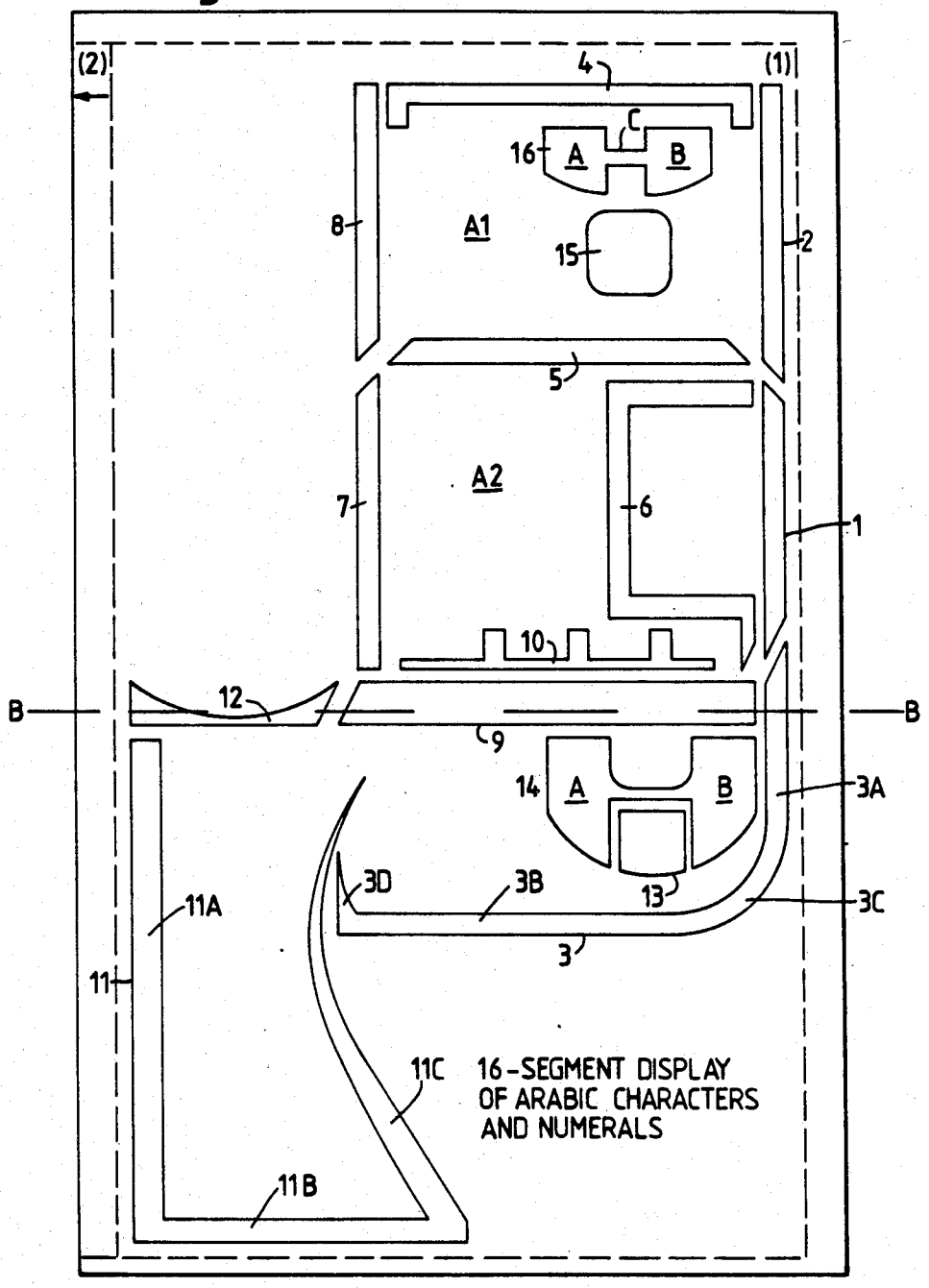
FIG. 1 shows one embodiment of display device according to the present invention and illustrates the approximate shapes and relative dimensions and positions of segments in the display.

In the following, the invention will be described principally by reference to its application to a display device but it will be appreciated that the various features and concepts disclosed are equally applicable to printing devices, whether of impact, thermal or any other type. Dot matrix (whether thermal or impact), daisywheel and various other printing methods (e.g. laser printing) are suitable for composing characters from basic character segments such as those provided by the present invention. The segments used in such methods in such a method will be characterized by an attractive geometrical style and a welcome economy in the number of characters needed since the invention has made it possible to use only one character form for the letter at the beginning or in the middle of the word and one form for the letter at the end of the word. Also the number of possible character widths is limited to two (that of segment 9 or 9+12 in the drawings). The simple algorithm described below makes the present method a suitable basis for a simple and economical printing device of the daisy wheel type and for developing a printing device of the dot matrix type.

FIG. 1 shows a display element embodying the present invention which may be implemented by any suitable display technology (e.g. liquid crystal or light emitting diode) and has a number of independently energizable segments to be described in more detail below. The display may, and indeed preferably does, comprise a number of sets of segments as shown in FIG. 1 disposed in side-by-side relation to provide a series of character positions so that words and multiple-digit numbers can be displayed.

For each character position, three types of segments may be identified: (1) Segments which are essential for adequate display of Arabic numerals and letters; (2) segments primarily required to join adjacent characters, where more than one character is being displayed simultaneously or where characters are being printed side-by-side; and (3) additional segments necessary to provide descenders, some of which are essential for some letter forms when the letters are located at the end of a word, to improve legibility of the display and so forth.

Type 1 Segments

In the display of FIG. 1, seven segments, 1, 2, 4, 8, 7, 10 and 5 are arranged in a configuration similar to that of a conventional seven-segment display, that is two pairs of segments, 1, 2, 7, 8, are arranged to provide a pair of spaced apart uprights and three cross bar segments, 4, 5 and 9 are provided extending between the upright segments and defining with them enclosed areas A1 and A2. The lower cross-bar 9 defines a baseline B—B of the character position.

Within the lower area A2 is a further segment 6 which is shaped so as completed by the upper, major part of the right, lower upright segment. In this example the segment 6 is shown as conforming to three sides of a rectangle with a "tail" at its righthand lower side. It will be appreciated that the segment 6 can have various other shapes, such as semicircular or two sides of a triangle. Located within the upper area A1 are two segments 15 and 16 which, when energized together, are intended to give the appearance of three dots arranged in a triangle; the apex can be upwardly or downwardly directed. The segment 15 provides one dot, while the segment 16 has two portions A and B intended to provide a pair of horizontally spaced dots and a linking portion C which is intended to be narrow or unnoticeable.

A further triangular group of three dots is provided below the cross-bar segment 9 by two segments 13 and 14. Again the segment 13 is intended to provide a single dot, the segment 14 being intended to provide two horizontally spaced dots, while the two segments 13 and 14 are intended to provide an enclosure completed by the right-side of segment 14.

Type 2 Segments

With the arrangement shown, there is only one type 2 segment, namely the segment 12 which is located on the base line B—B and so as primarily to provide, when energized a linking line between adjacent characters if such characters are joinable or to provide when not energized the necessary gap between non-joinable adjacent letters. The linking segment may have another function as it forms part of the lower descending ending for 5 characters, namely Ha, Kha, Jeem, Ain and Ghain; also the absence of this segment, i.e. its not being energized, provides the gap that must follow non-joining letters. As shown, the linking segment 12 has a concave upper surface but it may instead be rectangular as in FIG. 9, for example.

Type 3 Segments

The embodiment of FIG. 1 has two descender segments, 11 and 3.

The descender segment 11 has a first portion A which extends downwardly from the base line B at the left-hand end of the linking segment 12 through a height of approximately equal to the height of the rectangle defined by segments 1, 2, 4, 8, 7 and 9. A second portion 11B extends rightwardly from the lower end of portion 11A to terminate roughtly below the lower upright defined by segment 7 and 8. A further portion 11C extends upwardly towards the base-line B—B and, in so doing, slopes generally to the left. As shown, the upper part of the portion 11C is curved back towards the cross bar segment 9.

The second descender segment 3 has a first portion 3A extending downwardly from the lefthand corner of the rectangular array of segments 1, 2, 4, 8, 7 and 9 and a leftwardly directed portion 3B. The segment 3 is preferably so shaped as to improve appearance and recognizability of the letters Ra and Zai and the letters Ya and Lam when they occur at the end of a word—as shown, this is achieved by the portions 3A and 3B being interlinked by a curved portion 3*c*. the provision of a "tail" 3*d* at the lefthand end of the portion 3*b* is intended to resemble the upright "tail" of the end of word Lam and Ya; the need for the "tail" 3*d* is removed if a further filling segment is used between the 3*b* and the base-line as in FIG. 9 by the way of example.

Table 1 (below) defines 45 alphabetical Arabic characters, which are considered in accordance with this invention to be essential for the segmented display of Arabic alphabetical letters where said definitions are expressed in terms of segment number combinations, where these numbers are as indicated in FIG. 1.

Table 2 (below) defines five additional characters, each formed as a combination of one of five non-joinable Arabic letters (i.e. dal, thal, ra, zai, waw) followed by an alef. It is strongly preferred that the characters in Table 1 be complemented by the characters in Table 2 and that the combination of characters from Tables 1 and 2 be considered as the minimum number of characters need for segmented display of Arabic alphabetical letters and words in fully recognizable form.

Table 3 (below) defines the characters corresponding to Arabic as well as European numerals in terms of segment number combinations.

Table 4 (below) shows examples of some additional optional characters such as a full stop/decimal point, brackets, colon, etc.

Table 5 (below) shows an overall list of characters which are to be used essentially or optionally in the operation of said display device. The character information in Table 5 is obtained from Tables 1 to 4 after combining characters which share the same segment combination and after reorganizing the whole set of characters and their listing sequence.

Figure 9:
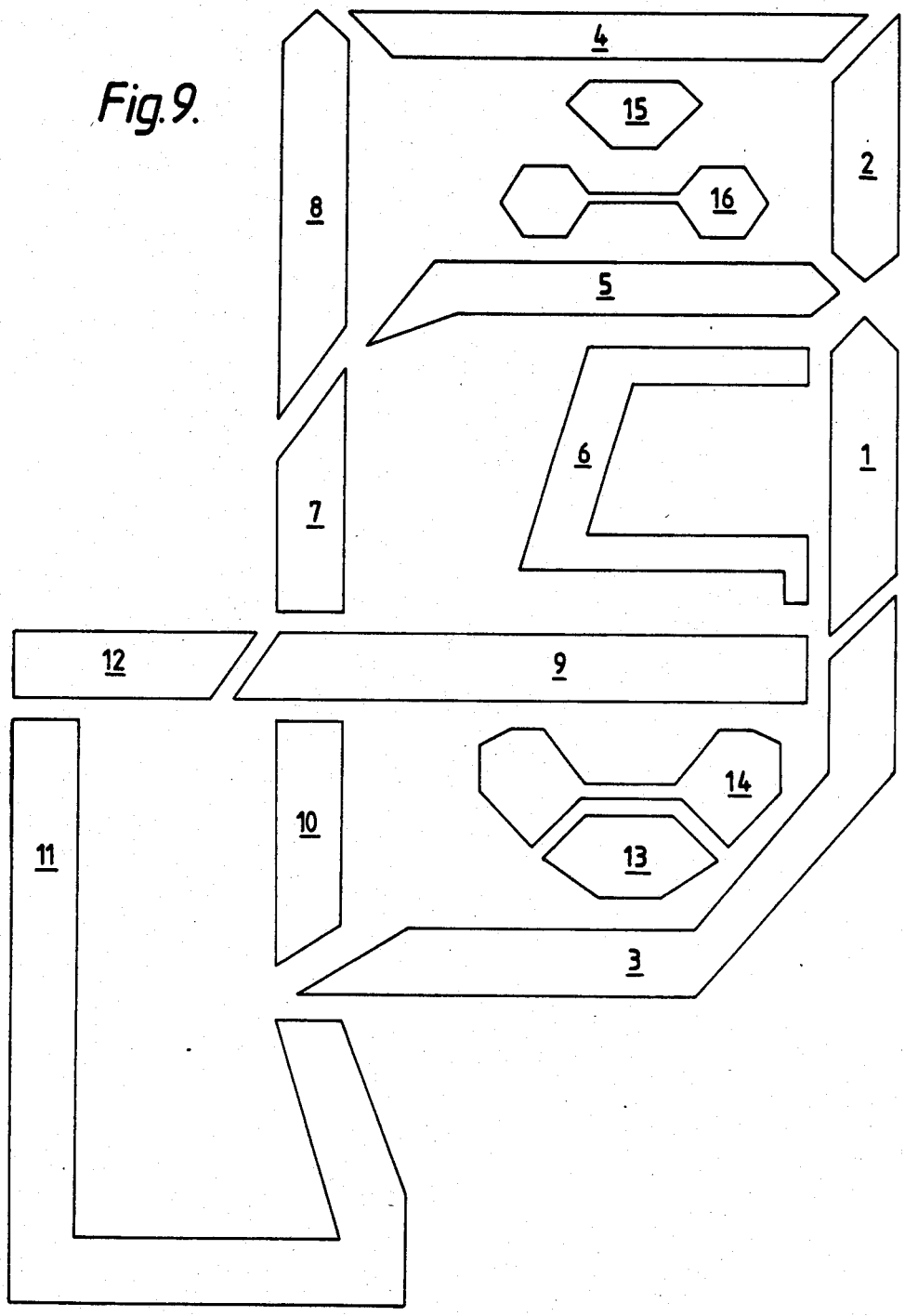
FIG. 9 shows a second embodiment of display device according to the present invention.

Table 6 provides examples of additional or modified character forms which can be derived from the second display embodiment in FIG. 9.

Referring back to FIG. 1, the dotted line frame defines approximately the area to be occupied by each of the identical segment arrangements in the display device. Each of said arrangements is capable, through selective control of its elements, of displaying any one character out of a large number of characters which are shown, by way of example, in the Tables. The extensions of the top and bottom parts of the said frame to the left indicates the beginning of the next character frame on the left as Arabic is written from right to left. The numbers shown between parentheses at the top righthand corner of each frame indicate how the display area of the device is divided into successive character frames the total numer of which can be as small as one but preferably more than six per row of characters.

The position of the two vertical dotted lines, shown in FIG. 1 indicates that the gap between the lefthand edge of segment 12 in one character frame and the righthand edge of segment 9 in the next frame on the left should be made as small or nearly as small as the gap betwen two adjacent segments within the same character frame. Examples of the desired smallness of the gaps are the narrow gaps between segment 1 and 2, between 7 and 8, between 10 and 9 etc., which can be seen on inspection of FIG. 1. The gaps should be small enough in order to render the two neighboring segments visually joined when displayed simultaneously. The reason for visually joining segment 12 from one character to segment 9 of the next character in the same word is that most Arabic letters are joined to the following letter in the same word. Letters which do not join with the following letter are those listed in Table 2 in addition to the alef. The width of said non-joinable letters is nearly equal to the length of segment 9, leaving a gap between such letter and the following letter in the same word which is approximately equal to the length of segment 12. The width of all letters according to the present segment arrangement is therefore either equal to the sum of the lengths of segments 9 and 12 for joinable letters or the length of segment 9 only for non-joinable letters, the alef and the hamza being special cases of obviously smaller widths.

Ignoring the thicknesses of segments 1 to 12, shown in FIG. 1, then the horizontal parts of the segments define five horizontal levels which are from bottom to top: The level defined by the flat part of segment 11, the level defined by the flat part of segment 3, the level of the baseline B—B defined by segments 9 and 12, the level defined by segment 5 and the level defined by segment 4. The plurality of levels allow for variation in levels and heights of alphanumerical characters and for the display of the characters in fully reorganizable form.

The segment 10 is provided solely for the display of the "teeth" of the "seen" and "sheen" letters. an alternative to the segment 10 is to make the crossbar segment 9 of 2 interfitting segments 9*a* and 9*b*. The inclusion of the optional segment 10 as in FIG. 1 may be preferred, although in some applications it may be removed or it may be given another function which serves to generate new character forms; an example of such different function for segment 10 is provided by the additional embodiment if the display device shown in FIGS. 9.

Figure 2:
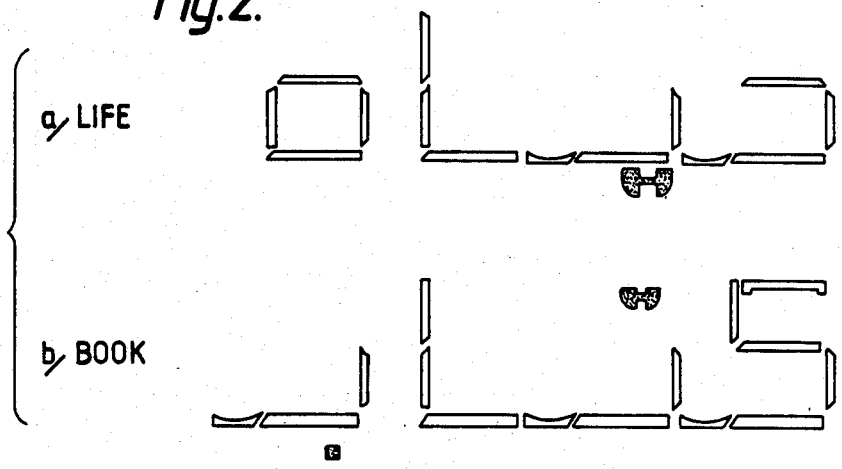
FIGS. 2 to 7 show, in drawings of relative scale, twelve examples, labelled (a) to (l) of Arabic words as would be obtained from the display device of FIG. 1.
Figure 3:
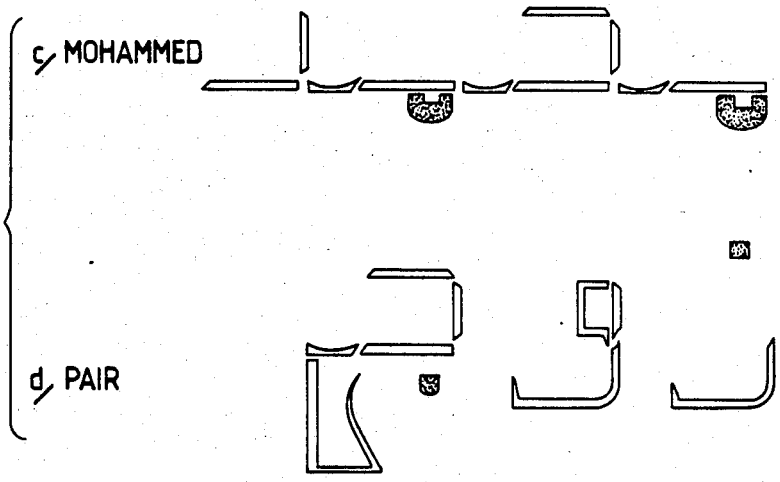
Figure 4:
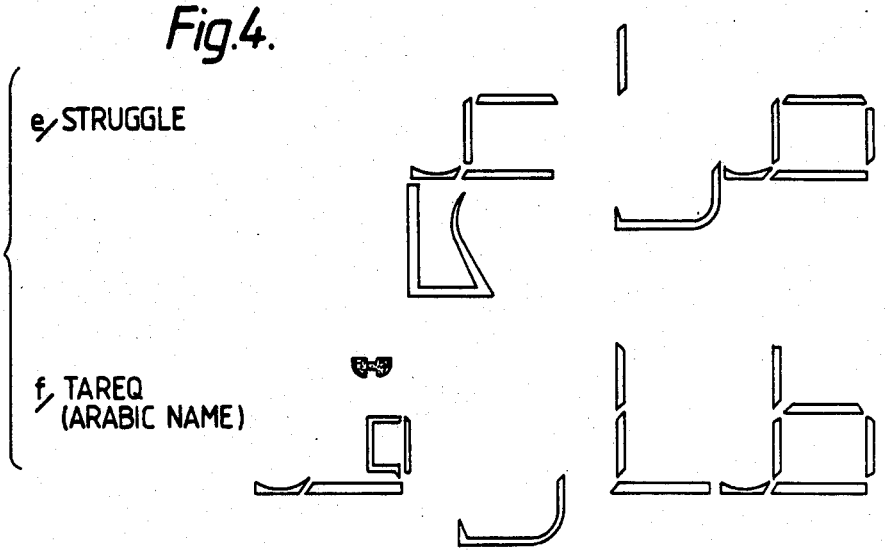
Figure 5:
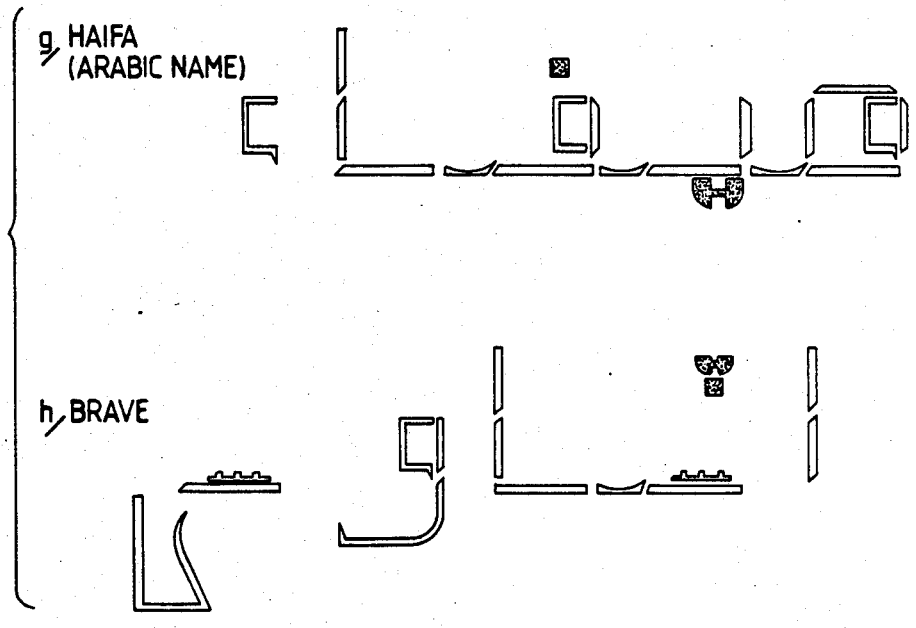
Figure 6:
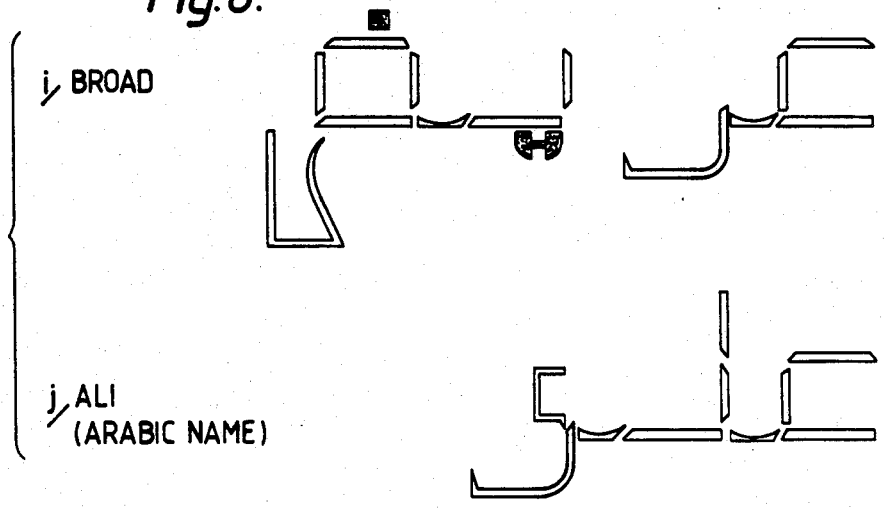
Figure 7:
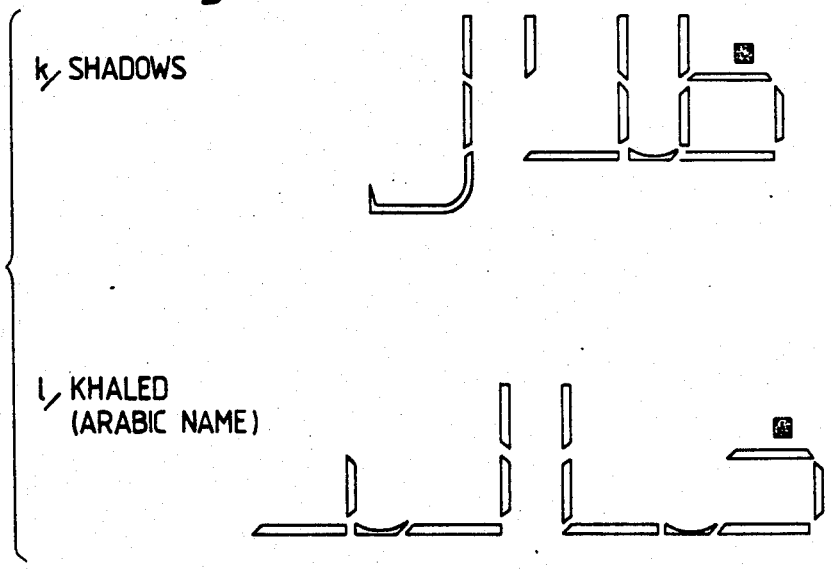

The alphanumeric characters which are considered essential for display of Arabic letters and words are listed in Tables 1 and 2. The characters in Table 1 are classified into characters of letters in Mode A and characters of letters in Mode B corresponding to letters occurring at the beginning or middle of the word or occurring at the end of the word, respectively. This definition is intended to apply to all letters except the Alef where mode-B is intended to correspond to the Alef occurring at in the middle or at the end of a word and mode-A to correspond to the Alef occurring at the beginning of a word. In a number of cases the two modes have the same character form as in the case of the letters listed in Table 2, the ta and the Tha. In a number of other cases the difference in character form between the two modes was not considered critical enough to necessitate a distinction in display and the A form was adopted for both modes. The latter cases include ba, ta, tha, noon, fa, gaf and kaf. For these letters, the shape of segment 12 which is curved inwardly in a sickle-like fashion serves to give the appearance of a letter ending, as shown by way of example in FIGS. 2-*b* and 4-*f*. However, it is possible to obtain from the present invention some suitable and distinct B-mode character forms for most of said letters and to improve the appearance of the B-mode form of some other letters; this can be seen from inspection of FIG. 9 and the information in Table 6A and 6B. This illustrates the advantages that may be gained from assigning a different function to the optional section 10.

The main function of segments 11 and 3 is to provide the character shape which is characteristic of Mode B when the shape is distinctly different from shape of Mode A. Examples of Mode B shapes are shown by the end of most example words given in FIGS. 2 to 7. The gradually changing wedge-like curving shape of the tail of segment 11, together with the rest of the segment, serve to provide the end part of most characters in B-mode, namely, seen, sheen, Sad, dad, ain, ghain, jeem ha, and kha. The function of segment 3, on the other hand, is to provide the end part of the B-mode ya and lam, in addition to its function of providing the character form of the low-descending ra and zai. As mentioned before, however, improvement in the appearance of the B-mode forms of these letters can be achieved through assigning a different function to the optional segment 10; this can be seen from inspection of FIG. 9 and the information in Table 6.B.

The letters listed in Table 2 are all listed in Table 1, but Table 2 gives the new character form which must replace that of any letters in said Table 2 and the following alef if such letters is followed by an alef in the same word. This is done in accordance with present segment arrangement as otherwise unwanted gaps will arise in the middle of the word. In Table 5, the special five characters of Table 2 are combined with those in Table 1 through defining the character forms of Table 2 as corresponding to a third letter Mode C. This mode occurs when a new character must be used as a result of a special sequence involving two letters of those letters listed in Table 1. In this spirit, the lam-alef-A, the alef-B and the second ha-B characters, all listed in Table 1, belong to Mode C characters as do the characters of Table 2. This is done in Table 5 where all latter said characters are combined under the common label of Mode C.

Figure 8:
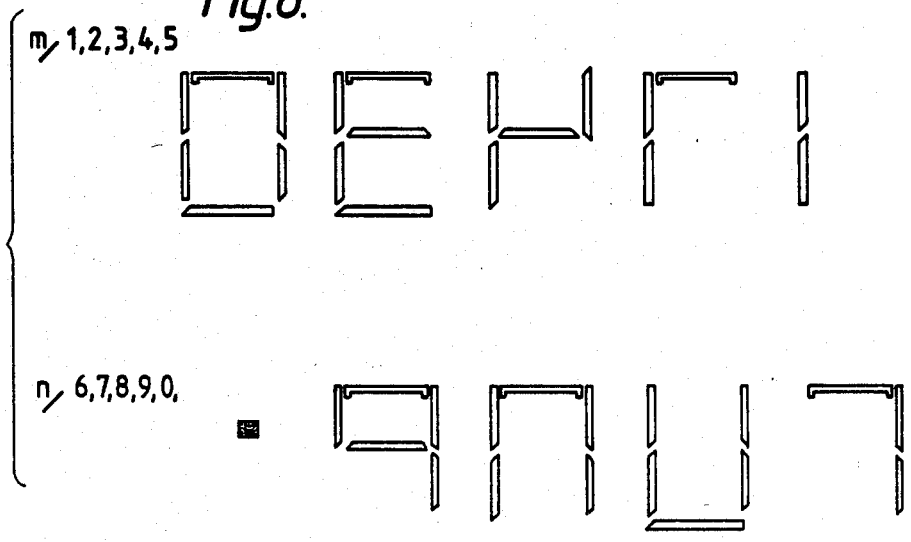
FIG. 8 shows examples, in drawings of relative scale, of the numerals from (0) to (9), which are used in most Arabic countries, as would be obtained from the display device of FIG. 1.
Figure 10:
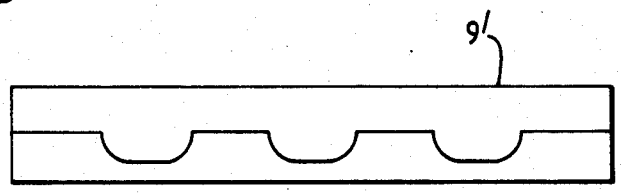
FIG. 10 shows a modification of one of the segments.

The characters listed in Table 3 correspond to Arabic and European numerals. The word Arabic is used here to indicate the numerals which are currently used in the Arab Middle East. The European numerals are those used in the Western world and in Arab North Africa. FIGS. 8-*m* and 8-*n* illustrate the appearance of the Arabic numerals. Numerals 7 and 8 both resemble rectangles with the upper or lower side missing, respectively. The shapes are different from the more familiar angular shapes for the numerals but they present no problem of recognizability and indeed, the two numerals form, together with the rest of the numerals, an elegant modern set.

The optional characters listed in Table 4 are given by way of example. The total number of optional characters that can be obtained from this invention depending on the function assigned to segment 10 and the detailed shapes chosen for the various other segments; inspection of Table 6C and FIG. 9 provides an example of some such additional optional characters.

Table 5 gives a reorganized list of all characters listed in first four Table 1, 2, 3 and 4, where all alpha-numerical characters are classified into A, B or C modes and where characters from different groups but having the same form are defined as one character. Table 5 shows that the display device associated with this invention requires 51 alpha-numeric characters to provide it with its full capability of displaying Arabic letters and words. The device also requires eight more characters for the generation of Arabic numerals as well as one more characters for displaying the decimal point/full stop. The total of all the essentially required characters is therefore 60.

The information given in FIG. 1 and Table 5 and explanations thereof herein provide the new information which is needed for the construction of a display device based on the present invention, as well as the accompanying electronic arrangement for its operation and control, through the use of current opto-electrical and electronic technologies. The opto-electrical segments of said device may be, for example, gas discharge or light-emitting diode elements but are preferably liquid crystal elements bonded between two plain electrodes, the front one of which being transparent. The many advantages of liquid crystal displays which include ultra-low power consumption, wide range of temperature tolerance and high visual contrast in ordinary ambient light conditions make them particularly suitable for use in the Arabic countries.

As FIG. 1 shows, most segments provided by the arrangement of this invention are directly accessible for electrical connection by virtue of the nearly empty area in the second and third quadrants of the arrangement. In such cases where some of segments form an enclosure-like subarrangement, such as for example is the case for segments 1,5,7, and 9, there always exist several gaps through which the segments inside the enclosure can be accessed in additions to the fact that the number of external electrical connections for the device are made substantially less than the total number of device segments through the use of multiplexed driving of device, as is preferred.

A typical electronic arrangement which is needed for control and operation of the device would include a decoder and a driver circuit which are preferably provided on the same chip. On the date input side, a keyboard conforming to ISO standards is preferably used for selecting Arabic letters and words to be displayed by said device. In order to use the keyboard in connection with the device a one-to-one correspondence may be defined between the set of at least the first sixty Arabic characters listed in Table 5 and an equal number of ASCII characters. The correspondence is preferably defined according to current conventions or in some other meaningful manner; it is also preferable that the B-mode for a letter is generated when the key for that letter is pressed in combination with a shift key. For example, the Mode-A Arabic alef is associated with the ASCII A, the ba with B, number 6 (Arabic) with number 6 ASCII and so on. It is also preferable that Mode-B characters are associated with ASCII control characters obtained from the combination of the ASCII control key and the corresponding Mode-A character. In this manner, if a certain key is associated with a certain Arabic letter then the pressing of that key will generate the Mode-A character of that letter while the pressing of the same key in combination with the shift key generates Mode-B character of said letter.

The method described in the last paragraph results in the assignment of a code number to every Arabic character listed in Table 5 or any other character that can be obtained from the present invention as, for example, those shown in Table 6. A table consisting of one column of the Arabic characters as listed in Table 5 for example and a second column of corresponding code numbers of the characters is equivalent to a preliminary Arabic character code which is preferably adopted in the design of the electronic arrangement accompanying the display device.

The decoder/driver circuit which is to convert input character code numbers to 15- or 16-segment representation, as required by said display device, differs from standard or commonly used circuits of this nature in that it performs different docoding logic and must be designed in accordance with information provided by Table 5. The combination of the said preliminary Arabic character code and the segment representations given in Table 5, under the heading of "segment combinations", form together what is essentially the truth table for the decoder circuit.

It is preferred, in view of the special logical requirements of the Arabic display device, to replace the electronic hardware mentioned above by a suitable microprocessor unit which is interfaced with the keyboard at its input port side and interfaced with the display device at its output port side. The keyboard interface, which must suit the microprocessor port, provides the keyboard readings while the display interface, which must suit the microprocessor output port, performs the driving but not the decoding function. Both keyboard and display operations which include encoding, decoding and multiplex driving are now preferably controlled by the CPU of said microprocessor through appropriate simple routines written into the ROM of the said microprocessor; any memory locations needed for the execution of the routine or any other routines are preferably provided by the RAM part of said microprocessor. Thus, instead of constructing special purpose hardware for the decoder logic of the device the relevant truth table is simply written into the ROM. Additional routines can also be written into ROM which greatly simplify the keyboard operations in such a way that the operator will deal only with the 28 Arabic alphabetical letters in their A-mode character forms while the introduction of B- and C-mode characters is handled by the microprocessor routines. Preferably a routine is written into the ROM of said microprocessor which will perform the following tasks:

Normally an input character is assigned Mode-A character code except in the following situations:

1. If the input key is combined with the shift key then the corresponding B-mode character code is assigned to that input.

2. If the input key was that of an Alef and was directly preceded by the letter Dal, Thal, Ra Zai, Waw, or Lam in the same word then the said preceding letter should be changed to its C-mode which would then be displayed in lieu of both the preceding letter and the following Alef on the other hand, the said C-mode can also be optionally accessed directly by the operator through inputting letter key in question in combination with the shift key.

3. If the input is alef-A and was preceded by any A-mode character except Dal, Thal, Ra, Zai, or Waw then input should be changed to alef-C.

4. If the input is a Ha in B-mode and was preceded by the letter Dal, Ra, Thal, Zai, Wow or Alef then the C-mode character form of the Ha will be assigned to the input.

The task of the keyboard operator is then reduced, as a result of preferred microprocessor arrangements described above, to simply typing one key for any letter and typing the key corresponding to the last letter in a word in combination with the shift key. The latter operation will prompt the display of B-mode character at the end of each word. The C-mode forms will on the other hand be introduced to the display without any intervention from the operator.

It will be appreciated where the invention is to applied to a printing device, the device will have individually energizable segments corresponding to those described above. The printing device may be any suitable form of printer (thermal printer, impact printer, electrostatic printer, etc.)

Tables 1–6 follow as part of this description.

TABLE 1

LIST OF CHARACTERS REQUIRED FOR DISPLAYING ARABIC LETTERS AND CORRESPONDING SEGMENT NUMBER COMBINATIONS WITH REFERENCE TO FIG. 1.

Definitions: Letter Mode A = Letter occurring at beginning or in middle of word
Letter Mode B = Letter occurring at end of word

| Arabic Letter | Segment Combination Mode A | Character Serial Number | Example FIGURE | Segment Combination Mode B | Character Serial Number | Example FIGURE |
|---|---|---|---|---|---|---|
| Alef | 7,8,9 | 1 | 5-b | 7,8,9 | 30 | 5-b |
| Ba | 1,9,12,13 | 2 | | same as A | — | 2-b |
| Ta | 1,9,12,16 | 3 | 2-b | same as A | — | |
| Tha | 1,9,12,15,16 | 4 | | same as A | — | |
| Noon | 1,9,12,15 | 5 | | same as A | — | |
| Jeem | 5,1,9,12,13 | 6 | | 5,1,9,12,13,11 | 31 | 3-d |
| Ha* | 5,1,9,12 | 7 | 3-C | 5,1,9,12,11 | 32 | |
| Kha | 5,1,9,12,15 | 8 | | 5,1,9,12,15,11 | 33 | |
| Dal | 1,9 | 9 | | same as A | — | 3-c |
| Thal | 1,9,15 | 10 | | same as A | — | |
| Ra | 3 | 12 | 3-f | same as A | — | |
| Zai | 3,15 | 13 | 3-d | same as A | — | |
| Seen | 9,10,12 | 14 | | 9,10,11 | 34 | 5-h |
| Sheen | 9,10,12,15,16 | 15 | 5-h | 9,10,15,16,11 | 35 | |
| Sad* | 7,5,1,9,12 | 16 | 4-e | 7,5,1,9,11 | 36 | |
| Dad* | 7,5,1,9,12,15 | 17 | | 7,5,1,9,11,15 | 37 | 6-j |
| Ta | 7,5,1,9,12,8 | 18 | 4-f | same as A | — | |
| Tha | 7,5,1,9,12,8,15 | 19 | 7-k | same as A | — | |
| Ain | 5,7,9,12 | 20 | 6-j | 5,7,9,12,11 | 40 | 4-e |
| Ghain | 5,7,9,12,15 | 21 | | 5,7,9,12,11,15 | 41 | |
| Fa | 6,1,9,12,15 | 22 | 5-g | same as A | — | |
| Qaf* | 6,1,9,12,16 | 23 | | same as A | — | 4-f |
| Kaf | 4,8,5,1,9,12 | 24 | 2-b | same as A | — | |

TABLE 1-continued

LIST OF CHARACTERS REQUIRED FOR DISPLAYING ARABIC LETTERS AND CORRESPONDING SEGMENT NUMBER COMBINATIONS WITH REFERENCE TO FIG. 1.

Definitions: Letter Mode A = Letter occurring at beginning or in middle of word
Letter Mode B = Letter occurring at end of word

| Arabic Letter | Segment Combination Mode A | Character Serial Number | Example FIGURE | Segment Combination Mode B | Character Serial Number | Example FIGURE |
|---|---|---|---|---|---|---|
| Lam | 2,1,9,12 | 25 | 7- | 2,1,3 | 42 | 7-k |
| Lam-Alef | 2,1,9,8 | 26 | 7-k | same as A | — | |
| Meem | 15,16,9,12 | 27 | 3-c | 15,16,9 | 43 | |
| Ba | 7,5,1,9,6,12 | 28 | 5-g | 6,1 | 44 | |
| | | | 3-d | 7,5,1,9** | 45 | 2-a |
| Wa | 6,1,3 | 29 | 3-d | same as A | — | |
| Ya | 1,9,12,14 | 30 | 5-g | 6,3 | 46 | 6-j |
| Hamza | 6,9,12 | 31 | | 6 | 47 | 6-g |

*A letter is underlined if it has a special pronunciation in Arabic which is different from that in English.
**This form of the letter (Ha) occurs when it is at the end of the word and following a non-joinable letter such as alef.

TABLE 2

CHARACTERS FOR SPECIAL LETTER COMBINATIONS WITH THE LETTER ALEF

If any one of the following letters is followed by an alef in the same word then both should be replaced by a new character given below:

| Letter followed by alef | Segment Combination | Character serial no. | Example FIGURE |
|---|---|---|---|
| Dal | 1,9,8 | 48 | |
| Thal | 1,9,15,8 | 49 | |
| Ra | 3,5 | 50 | 4-e |
| Zai | 3,15,8 | 51 | |
| Waw | 1,6,3,8 | 52 | |

TABLE 3-continued

ARABIC AND EUROPEAN NUMERALS

| Numeral | Segment Combination for Arabic character | Character Serial Number | Example FIGURE | Segment Combination for European Character | Character Serial Number |
|---|---|---|---|---|---|
| 5 | 1,2,4,7,8,9 | 57 | 8-m | 4,8,5,1,9 | 67 |
| 6 | 4,2,1 | 58 | 8-n | 4,8,7,9,1,5 | 68 |
| 7 | 1,2,9,7,8 | 59 | 8-n | 4,2,1 | 69 |
| 8 | 1,2,4,7,8 | 60 | 8-n | 1,2,4,8,7,9,5 | 70 |
| 9 | 1,2,4,8,5 | 61 | 8-n | 1,2,4,8,5 | 71 |
| zero | 15 | 61 | | 1,2,4,7,8,9 | 72 |

TABLE 3

ARABIC AND EUROPEAN NUMERALS

| Numeral | Segment Combination for Arabic character | Character Serial Number | Example FIGURE | Segment Combination for European Character | Character Serial Number |
|---|---|---|---|---|---|
| 1 | 7,8 | 53 | 8-m | 7,8 | 63 |
| 2 | 7,8,4 | 54 | 8-m | 4,2,5,7,9 | 69 |
| 3 | 2,5,7,8 | 55 | 8-m | 4,2,5,1,9 | 65 |
| 4 | 4,7,5,8,9 | 56 | 8-m | 8,5,2,1 | 66 |

TABLE 4

| Character | Segment Combination | Character Serial Number |
|---|---|---|
| Full stop/decimal point | 15 | 73 |
| Left hand bracket | 4,7,8,9 | 74 |
| Right hand bracket | 4,1,2,9 | 75 |
| Colon | 13,15 | 76 |
| Equality sign | 5,9 | 77 |
| Minus sign | 5 | 78 |
| Multiplication | 15,16 | 79 |

TABLE 5

REORGANIZED OVERALL LIST OF CHARACTERS REQUIRED FOR OPERATION OF DISPLAY DEVICE

Definitions: E = Essentially required
O = Optionally required
Letter Modes A and B = as defined in Table 1 above.
Letter Mode C = letter occurring in special combinations with another letter leading to the formation of a new character

| New Character Number | Character Mode | Type E or O | Segment Combinations | New Character Number | Character Mode | Type E or O | Segment Combination |
|---|---|---|---|---|---|---|---|
| 1 | Alef-A | E | 7,8 | 37 | Dad-B | E | 7,5,1,9,11,15 |
| 2 | Ba-A | E | 1,9,12,13 | 38 | Ain-B | E | 5,7,9,12,11 |
| 3 | Ta A | E | 1,9,12,16 | 39 | Ghain-B | E | 5,7,9,12,11,15 |
| 4 | Tha-A | E | 1,9,12,15,16 | 40 | Lam-B | E | 2,1,3 |
| 5 | Jeem-A | E | 5,1,9,12,13 | 41 | Meem-B | E | 15,16,9 |
| 6 | Ha-A | E | 5,1,9,12 | 42 | Ha-B | E | 6,1 |
| 7 | Kha-A | E | 5,1,9,12,15 | 43 | Ya-B | E | 6,3 |
| 8 | Dal-A | E | 1,9 | 44 | Hamza-B | E | 6 |
| 9 | Thal-A | E | 1,9,15 | 45 | Lam-C | E | 2,1,9,8 |
| 10 | Ra-A | E | 3 | 46 | Ha-C | E | 1,9,7,5 |
| 11 | Zai-A | E | 3,15 | 47 | Dal-C | E | 1,9,8 |
| 12 | Seen-A | E | 9,10,12 | 48 | Thal-C | E | 1,9,15,8 |
| 13 | Sheen-A | E | 9,10,12,15,16 | 49 | Ra-C | E | 3,8 |
| 14 | Sad-A | E | 7,5,1,9,12 | 50 | Zai-C | E | 3,15,10 |

TABLE 5-continued

REORGANIZED OVERALL LIST OF CHARACTERS REQUIRED FOR OPERATION OF DISPLAY DEVICE

Definitions: E = Essentially required
O = Optionally required
Letter Modes A and B = as defined in Table 1 above.
Letter Mode C = letter occurring in special combinations with another letter leading to the formation of a new character

| New Character Number | Character Mode | Type E or O | Segment Combinations | New Character Number | Character Mode | Type E or O | Segment Combination |
|---|---|---|---|---|---|---|---|
| 15 | Dad-A | E | 7,5,1,9,12,15 | 51 | Waw-C | E | 6,1,3,8 |
| 16 | Ta-A | E | 7,5,1,9,12,8 | 52 | 2(Arabic) | E | 7,8,4 |
| 17 | Tha-A | E | 7,5,1,9,12,8,15 | 53 | 3(Arabic) | E | 2,5,7,8 |
| 18 | Ain-A | E | 5,7,9,12 | 54 | 4(Arabic) | E | 4,7,5,8,9 |
| 19 | Ghain-A | E | 5,7,9,12,15 | 55 | 5(Arabic)* | E | 1,2,4,7,8,9 |
| 20 | Fa-A | E | 6,1,9,12,15 | 56 | 6(Arabic)* | E | 4,2,1 |
| 21 | Qaf-A | E | 6,1,9,12,16 | 57 | 7(Arabic) | E | 1,2,9,7,8 |
| 22 | Kaf-A | E | 4,8,5,1,9,12 | 58 | 8(Arabic) | E | 1,2,4,7,8 |
| 23 | Lam-A | E | 2,1,9,12 | 59 | 9(Arabic)* | E | 1,2,4,8,5 |
| 24 | Meem-A | E | 15,116,9,12 | 60 | decimal | E | 15 |
| 25 | Noon-A | E | 1,9,12,15 | | point/full | | |
| 26 | Ha-A | E | 7,5,1,9,6,12 | | stop | | |
| 27 | Waw-A | E | 6,1,3 | 61 | LH bracket | O | 4,7,8,9 |
| 28 | Ya-A | E | 1,9,12,14 | 62 | RH bracket | O | 4,1,2,9 |
| 29 | Hamza-A | E | 6,9,12 | 63 | colon | O | 13,15 |
| 30 | Alef-C/ | E | 7,8,9 | 64 | minus sign | O | 5 |
| 31 | Jeem-B | E | 5,1,9,12,13,11 | 65 | equality sign | O | 5,9 |
| 32 | Ha-B | E | 5,1,9,12,11 | 66 | multipli- | O | 15,16 |
| 33 | Kha-B | E | 5,1,9,12,11,15 | | cation sign | | |
| 34 | Seen-B | E | 9,10,11 | 67* | 2(European) | O | 4,2,5,7,9 |
| 35 | Sheen | E | 9,10,15,16,11 | 68 | 3(European) | O | 4,2,5,1,9 |
| 36 | Sad-B | E | 7,5,1,9,11 | 69 | 4(European) | O | 8,5,2,1 |
| | | | | 70 | 5(European) | O | 4,8,5,1,9 |
| | | | | 71 | 6(European) | O | 4,8,7,9,1,5 |
| | | | | 72 | 8(European) | O | 1,2,4,8,7,9,5 |

*Characters for the missing European 1, 7, 9 and zero are provided by the Arabic 1, 6, 9 and 5, respectively.

TABLE 6

ADDITIONAL CHARACTER FORMS AND MODIFICATIONS DERIVED FROM THE EMBODIMENT OF FIG. 9

| Character | Segment combination (in FIG. 9) |
|---|---|
| A. Additional B-mode character forms: | |
| BA | 1,9,7,13 |
| TA | 1,9,7,16 |
| THA | 1,9,7,15,16 |
| FA | 6,1,9,7,15 |
| QAF | 6,1,3,10,16 |
| NOON | 1,3,10,15 |
| B. Modified character forms: | |
| MEEM -B | 13,14,9,10 |
| SEEN -A | 9,12 |
| SHEEN -A | 9,12,15,16 |
| SEEN -B | 9,11,10 |
| SHEEN -B | 9,11,10,15,16 |
| SAD -B | 7,5,1,9,10,11 |
| DAD | 7,5,1,9,10,11,15 |
| YA -B | 6,3,10 |
| LAM -B | 1,2,3,10 |
| C. Additional optional character forms: | |
| ARABIC ZERO/ ENGLISH DECIMAL | 7 |
| + SIGN | 7,10,9,12 |
| ARABIC QUESTION MARK | 4,8,5,1,15 |

I claim:

1. A device for producing Arabic numerals and letters and having at least one character position defined by a set of selectively energizable segments, the set comprising: first thru seventh segments which are bar-shaped and arranged in a seven-segment figure 8 configuration comprising right and left uprights and top, middle and lower crossbars, the first thru fourth segments respectively constituting right-lower, right-upper, left-lower and left-upper portions of the uprights and the fifth thru seventh segments constituting said top, middle and bottom crossbars respectively and defining with the first thru fourth segments upper and lower enclosed areas, the seventh segment, constituting the lower crossbar defining a baseline of the character position; an eighth segment within the lower enclosed area and so shaped as to substantially form an enclosure, with at least a part of the right-lower segment; and upper and lower groups of segments each comprising at least two segments shaped to resemble one and two dots, respectively, one group being located within the upper enclosed area and the other group being located below the seventh segment, the upper group of segments, when energized, together resembling three dots and at least one of the lower group of segments, when energized, substantially forming an enclosure with the right-hand part of said seventh segment.

2. A device according to claim 1 wherein the segments forming the character position include a right-side descender segment having a first portion extending downwardly from the righthand end of the baseline and a second portion extending leftwardly from the lower end of its first portion, the length of which is at least approximately equal to that of the seventh segment.

3. A device according to claim 2, wherein the first and second portions of the right-side descender segment are connected by an inclined or curved portion.

4. A device according to claims 1, 2 or 3, wherein there are a plurality of said sets of segments so as to define a number of side-by-side character positions.

5. A device according to claim 4, wherein a further linking segment is provided on said baseline so as to provide a linking line between adjacent characters.

6. A device according to claim 5 wherein a number of such linking segments are provided, each between respective adjacent character positions and forming a leftward extension of the adjacent seventh segments.

7. A device according to claim 5, wherein the at least one set of segments includes a left-side descender segment having a first portion extending downwardly from the linking segment, a second portion extending rightwardly from the first portion and third portion extending upwardly from the second portion.

8. A device according to claim 6, wherein the at least one set of segments includes a left-side descender segment having a first portion extending downwardly from the linking segment, a second portion extending rightwardly from the first portion and third portion extending upwardly from the second portion.

9. A device according to claim 7 wherein the third portion of the left-side descender segment is inclined towards its first portion.

10. A device according to claim 8 wherein the third portion of the left-side descender segment is inclined towards its first portion.

11. A device according to claim 2 wherein the third portion of the left-side descender segment and the second portion of the right-side descender segment are located adjacent to one another.

12. A device according to claim 7 wherein the third portion of the left-side descender segment and the second portion of the right-side descender segment are located adjacent to one another.

13. A device according to claim 8 wherein the third portion of the left-side descender segment and the second portion of the right-side descender segment are located adjacent to one another.

14. A device according to claim 7 wherein the left-side descender segment substantially forms a further enclosure with the baseline of the character position.

15. A device according to claim 8 wherein the left-side descender segment substantially forms a further enclosure with the baseline of the character position.

16. A device according to claim 14 wherein said further enclosure is completed by a further segment extending upwardly from the third portion of the left-side descender segment toward the baseline.

17. A device according to claim 15 wherein said further enclosure is completed by a further segment extending upwardly from the third portion of the left-side descender segment toward the baseline.

18. A device according to claim 1, wherein the selectively energizable segments are segments of a liquid crystal or light emitting diode display.

19. A device according to claim 1, wherein each set of segments is a set of segments of a printing device for producing hard copy output.

* * * * *